US006874347B2

(12) United States Patent
Meichtry

(10) Patent No.: US 6,874,347 B2
(45) Date of Patent: Apr. 5, 2005

(54) PLANISHING DEVICE AND METHOD

(76) Inventor: Ralph Meichtry, Säumerstrasse 13, CH-8805 Richterswil (CH)

( * ) Notice: Subject to any disclaimer, the term of this patent is extended or adjusted under 35 U.S.C. 154(b) by 4 days.

(21) Appl. No.: 10/258,397

(22) PCT Filed: Dec. 5, 2000

(86) PCT No.: PCT/CH00/00643

§ 371 (c)(1),
(2), (4) Date: Oct. 24, 2002

(87) PCT Pub. No.: WO02/45877

PCT Pub. Date: Jan. 13, 2002

(65) Prior Publication Data

US 2004/0016282 A1 Jan. 29, 2004

(51) Int. Cl.[7] ..... B21D 1/06
(52) U.S. Cl. ..... 72/458; 72/390.5; 72/705
(58) Field of Search ..... 72/390.4, 390.5, 72/458, 705; 29/267

(56) References Cited

U.S. PATENT DOCUMENTS

| | | | | |
|---|---|---|---|---|
| 1,704,600 A | * | 3/1929 | Green | 29/267 |
| 2,949,144 A | * | 8/1960 | Dredske et al. | 72/390.2 |
| 3,635,072 A | | 1/1972 | Steinmann, Jr. | |
| 4,026,139 A | | 5/1977 | Glaser et al. | |
| 4,089,201 A | | 5/1978 | Raptis | |
| 4,930,335 A | | 6/1990 | Ishihara | |
| 5,203,196 A | * | 4/1993 | Jenkins | 72/391.2 |
| 5,333,486 A | | 8/1994 | Ishihara | |
| 5,951,818 A | | 9/1999 | Gaetano | |

FOREIGN PATENT DOCUMENTS

| | | |
|---|---|---|
| EP | 0 856 366 A2 | 8/1998 |
| EP | 0812635 B1 | 3/2000 |
| EP | 0 992 313 A1 | 4/2000 |

* cited by examiner

*Primary Examiner*—Lowell A. Larson
(74) *Attorney, Agent, or Firm*—Robert E. Bushnell, Esq.

(57) ABSTRACT

A planishing device (10) with a pulling element (11) and lever arms (151.1, 151.2) connected in an articulated manner, with bearing elements (12.1, 12.2) for bearing on a material layer (WS), characterised in that the lever arms (151.1, 151.2) in the region of the end (158.1, 158.2) lying opposite their grip are connected in an articulated manner to a joint member (157) connecting the lever arms (151.1, 151.2) at a location (161) distanced from these ends (158.1, 158.2), are supported in an articulated and movable manner via supports (162.1, 162.2) on a supporting element (16) that is interactively connected to the bearing elements (12.1, 12.2). Pulling element (11) is connected to joint member (157) via a rod (154).

25 Claims, 2 Drawing Sheets

Figure 1:
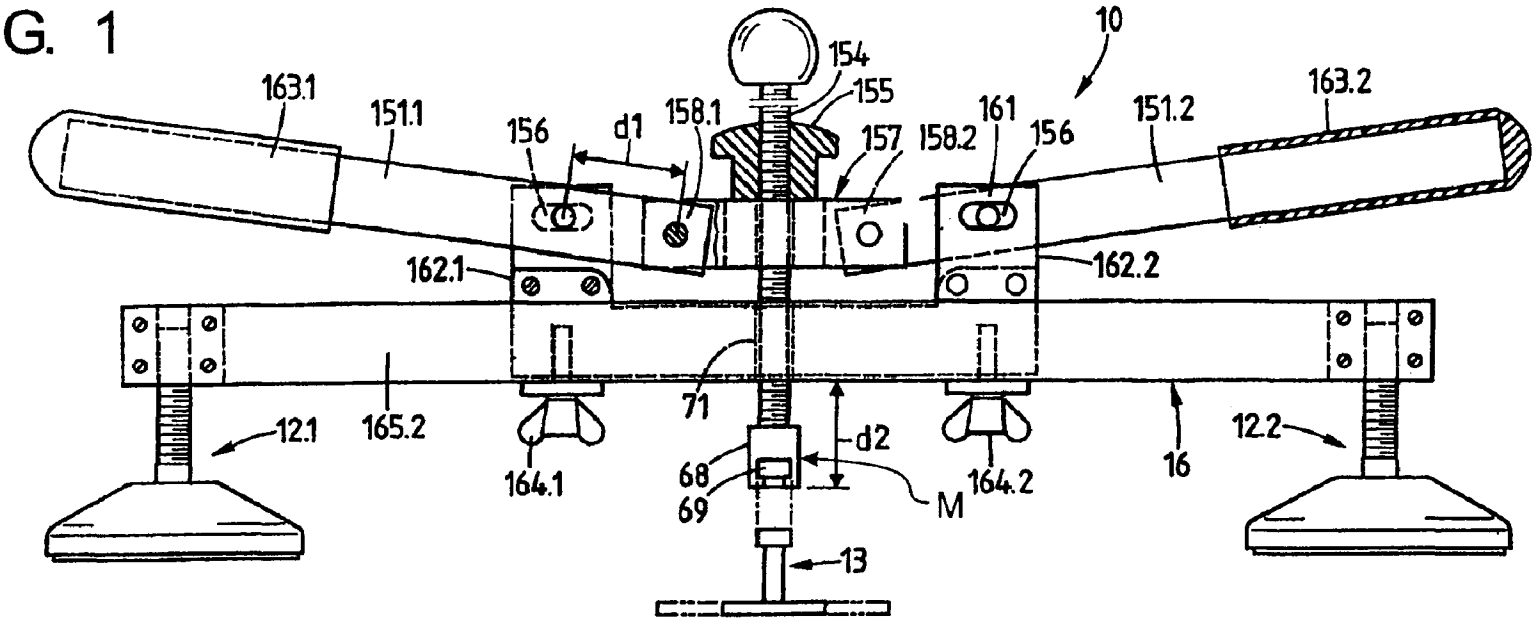

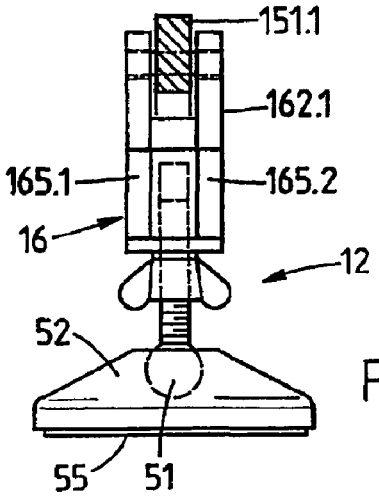
FIG. 3a
FIG. 3b
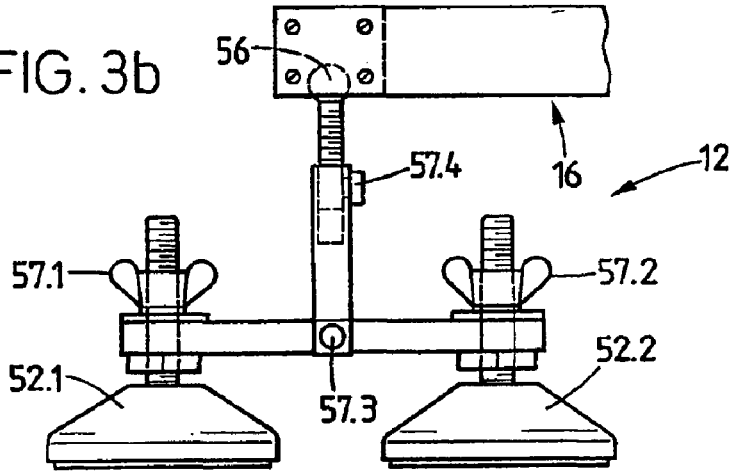
FIG. 4
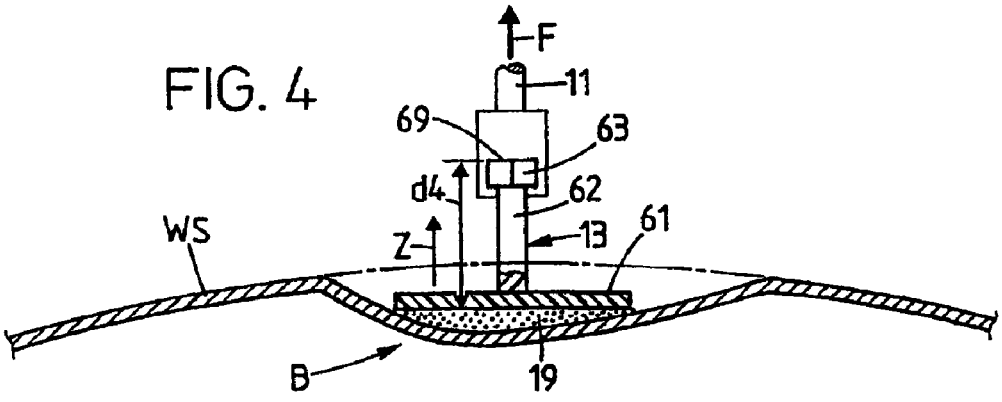

PLANISHING DEVICE AND METHOD

The invention relates to a planishing device and to a planishing method according to the patent claims 1 and 11.

There are known various devices for repairing dent-like or or indentation-like deformations on vehicles. From EP 681 876 there is known a lever device which by way of one or more levers supported at one point permits the planishing from the inner side of a deformed car body sheet. This device has the disadvantage that the inner side to be treated as a rule does not lay bare and that a precise handling is made difficult on account of the lever which is supported only at one point. Basically single lever devices also have the additional disadvantage that forces are transmitted onto the location to be treated or the support location in an oblique manner.

U.S. Pat. No. 4,026,139 shows a lever device with a lever pair which is mounted in the middle region in an articulated manner. A suction cap in each case is fastened at the end of each of the levers via a linkage. A U-shaped pulling element is pivotally linked in the linkage point of the lever pair and at the free end likewise comprises a suction cap which is to be placed at the location of the dent. Although this design has an adjustment possibility on account of additional bores on the two levers, it is however not suitable for the regularly required adjustments since the respective adjustment on the one hand is complicated and on the other hand on handling, it effects unequal lever lengths and lever forces as well as undesirable movement paths. This design may not be applied with a sufficient flexibility to more complex workpieces. In addition, above all with larger dents the distance of the two support locations compellingly changes during the planishing procedure, which results in the danger of scratches or in a handling which is difficult to control.

Various conventional planishing devices, thus for example U.S. Pat. No. 4,089,201, and U.S. Pat. No. 3,635,072 show designs with pulling elements which are adjustable with threaded rods and which may be adjusted by way of rotating wing nuts and likewise. These solutions are very bad to operate, above all when their actuation is to be carried out by a single operating person. Furthermore undesirable operating forces are required so that as a rule a hand operation is not possible as with U.S. Pat. No. 3,635,072.

The above described devices also have the common disadvantage that the devices are difficult to apply on the material to be planished, since the support parts as well as the pulling part of the devices must be applied essentially simultaneously. Although a later adjustment is possible with the mentioned lever design according to EP 681876, this however has the disadvantage that the support location for its part is loaded too greatly when it directly engages the material.

There are known further devices such as e.g. U.S. Pat. No. 4,089,201 which must penetrate the dent location in order to permit its planishing. It may however be easily deduced that this creates a later, additional repair effort which is to be avoided if possible. Belonging to the state of the art is also a single lever design with which the sheet to be planished is not pressed from the inside but is pulled from the outside, wherein its pulling element is adhesed in the dent region by way of adhesive. This solution too does not ensure any controlled force effect or a sufficiently fine and exact control of the pulling force which is exerted with this, and leads to an excess loading of the bearing location.

It is the object of the invention to provide a planishing device and a planishing method which may be easily operated with low actuation forces, permits a secure and simple support on the workpiece to be treated, is flexibly adjustable, if desired with an adjustability also during use, and leads to low counterforces on the bearing location.

This object is achieved by the invention defined in the patent claims.

The invention for the first time provides a device and a method for repairing dented or indented material layers, in particular car bodies of metal sheet or plastic which with low operating forces permit a metered force effect on the dent location to be re-shaped and on application as well as optionally when required, have an simple and flexible adjustability of the device.

The concept of the invention is based on the fact that the counterforces which counteract the necessary planishing force are distributed on at least two feet of bearing elements, wherein the force effect is introduced onto the pulling element essentially uniformly at all times via at least two adjustable levers acting on the pulling element.

For this purpose the planishing device contains two or more lever arms which in the region of their end lying opposite the grip are connected in an articulated manner to a joint member connecting the lever arms. The lever arms at a location distanced from these ends are supported on a supporting element in an articulated and movable manner via support means. The pulling element for its part is connected to the joint member. The supporting element is interactively connected to at least two bearing elements which for their part support the planishing device with respect to the workpiece to be treated.

The lever device of a planishing device according to the invention preferably has two lever arms with a transmission ratio of at least about 3:1.

Preferably at the same time the operating end of the pulling element is releasably connected to a connection element which has an end surface for connection to the material layer to be treated. This connection of the end surface to the material layer in a particularly preferred embodiment form is effected by way of a hot-melt adhesive which connects the parts to one another, but it may also be effected in a mechanical manner. Usefully the adhesive location at surrounding temperature has a strength which is sufficient only for a plastic deformation but is smaller than the breaking strength of the material layer in order to safely rule out any damage to the material layer. As a hot-melt adhesive one preferably uses a polymer with polar side-groups which is solid at room temperature and which softens or melts at temperatures of above 150 C. Such polymers are known and are obtainable on the market, such as e.g. copolymers with vinyl acetate, acrylates or acrylic acid, as well as hot-melt adhesives based on ionomers.

The method according to the invention is particularly suitable for application in the repair of bodies of vehicles, wherein the material layer consists of metal sheet, in particular steel sheet and any occuring cover layers are removed before adhesing to the connection element when their adhesive strength on the material layer is smaller than the required tensile strength of the adhesive location.

Figure 2:
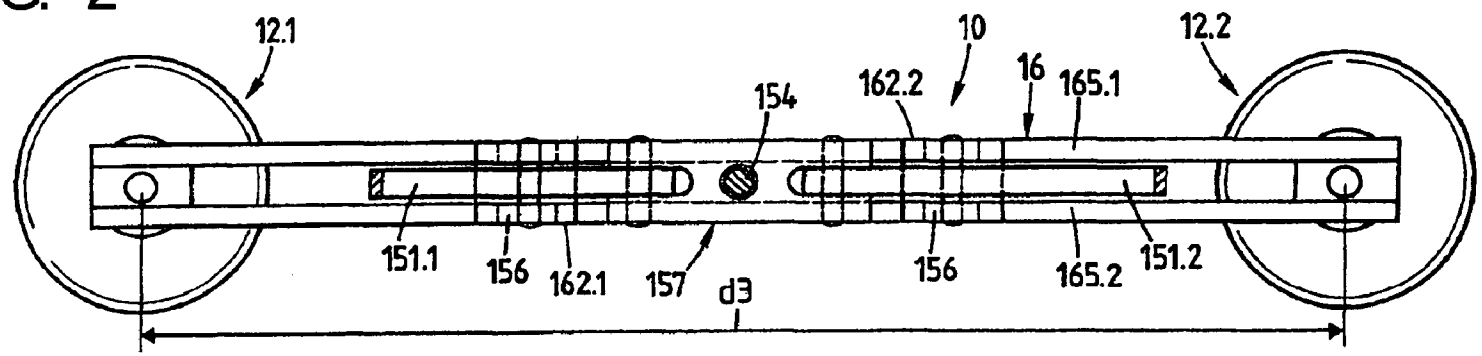

Embodiment examples of the invention are now explained in more detail by way of the figures. There are shown in:

FIG. 1 a semi-schematic representation of a device according to the invention in a lateral view;

FIG. 2 a part of the device of FIG. 1 in a plan view;

FIG. 3*a* a support device according to the invention in a lateral view;

FIG. 3*b* another support device according to the invention in a lateral view and FIG. 4 the schematic representation of an adhesive location on carrying out the method according to the invention.

FIG. 1 shows a planishing device 10 according to the invention with two lever arms 151.1, 151.2, with a joint member 157, with a supporting element 16 and support means 162.1, 162.2. The lever arms 151.1, 151.2 at their free end in each case have a grip 163.2 which is shown schematically at the second lever arm 151.2. Each lever arm 151.1, 151.2 at the end 158.1, 158.2 lying opposite the grip is connected to the joint member 157 in each case via a joint (here a pivot joint). Additionally the lever arms 151.1, 151.2 at a distance d1 from these pivot joints are likewise connected to the support means 162.1, 162.2 in an articulated manner. With this embodiment example these joint connections have a pivot or a pivot stub mounted in a slot-like opening 156 of the lever arms 151.1, 151.2. The supporting element 16 with this embodiment form is a straight rail on which the support means 162.1, 162.2 formed as slides are displaceable. These slides may be locked in a desired position on the arm by way of adjusting means 164.1, 164.2, e.g. wing nuts. The arm 16 is interactively connected at its ends in each case to bearing elements 12.1, 12.2, wherein these are adjustable in height with respect to the arm 16.

The pulling element 11 is adjustably connected to the joint member 157 by way of an adjusting head 155 via a rod 154 which is at least partly provided with a thread. The adjustability has the effect that the ratio of the distance d3 between the bearing elements 12.1, 12.2 to the maximal path d2 of the pulling element 11 is at least 10:1, preferably at least 20:1. The pulling element or the rod 154 is preferably guided, here by guiding slots or a bore 71, so that a defined force effect is ensured. The arrangement according to the invention has the effect that on actuation of the lever arms 151.1, 151.2 in the direction of the workpiece to be treated, the pulling element moves away from this and travels a desired part path of the maximal path d2. It is ensured that even with a non-uniform force effect on the lever arms 151,1, 152.2 the pulling element is uniformly moved away from the dent location and no undesired force components are introduced into the workpiece.

The pulling element 11 here at its free operating end 68 comprises a coupling means 69. This coupling means 69 permits a releasable connection to a connection element 13 which is connectable to the dent location to be deformed. In this embodiment example this coupling means 69 is formed by a recess in the region of the operating end 68 of the connection element 13, which preferably contains a catch mechanism, for example a flute or a groove so that the connection element 13 may not only be loosely inserted into the recess, but may find a secure hold therein. If desired one may also use alternative coupling means, e.g. a rigidly catching bayonette connection.

The design of the arm 16 with the slide may be easily recognised from FIG. 2, which shows a preferred embodiment form of the arm 16 with two distanced, straight rail parts 165.1, 165.2. With particular embodiment forms the support means 162.1, 162.2 may be additionally fixed at various positions of the supporting element 16 so that their mutual distance d3 may be varied. A particular advantage of the invention lies in the fact that the planishing device may be adjusted very flexibly according to its object and may be adapted practically to all conceivable workpiece geometries, but that the distance d3 between the bearing elements 12.1, 12.2 remains constant during the application of the tool and thus one achieves a secure and exact support whilst avoiding the disadvantages of the state of the art. In particular, compared to the initially mentioned single lever designs and U.S. Pat. No. 4,026,139, it is clear that the distance d3 although able to be adjusted, on application of the tool however does not undesirably change and no joint arrangements are necessary, which render the tool instable (cf. the pivot joint 32 in U.S. Pat. No. 4,026,139). Furthermore with the solution according to the invention the distance between the pulling element and the bearing elements 12.1, 12.2 remains constant. By way of this there are effected no undesired force components transverse to the surface of the material, which would very disadvantageously affect the application of a connection element 13 to be adhesed on account of the shear forces occuring in the adhesive location. The device according to the invention permits the deformation forces to be transmitted essentially perpendicular to the dent region (B) and a largely homogeneous flow of force.

With particular embodiment forms the supporting arm may differ from the straight rail form. In order to achieve a greater lift distance d2 (cf. FIG. 1) the supporting arm in the middle region may e.g. have a yoke-like, upwardly pointing geometry. In this case the support means 162.1, 162.2 remain displaceable on straight rail parts in the above described manner. Such yoke-like transitions may be mechanically connected to the rail parts or formed as one piece with these.

FIG. 3*a* shows a bearing element 12 in a lateral view. The arrangement of a three-axis joint which here is designed as a ball joint is particularly favourable. This permits the foot 52 of the bearing element 12 to move spacially so that the planishing device 10 may also be applied on spacially arcuate material parts in the desired angular position. According to the invention the foot 52 of the bearing element has as large a surface as possible which with a tool for planishing car bodies is approx. 20–30 cm2, and here is shaped in a circular manner. With a preferred variant of the bearing element 52 this has a fastening means 55 which may be temporarily connected and released to and from the material layer WS, such as e.g. a magnet or a suction pad.

In FIG. 3*b* there is shown a further preferred embodiment form of the bearing element 12. In order to achieve an improved distribution of the counterforces on the workpiece counteracting the pulling force and to ensure a good bearing with arcuate workpieces, the bearing element 12 is here provided with two feet 52.1, 52.2. The bearing element 12 is connected to the supporting element 16 in an articulated manner via a ball joint 56. The two feet 52.1, 52.2 are movably arranged with respect to the supporting arm via adjusting means 57.1, 57.2, 57.3, 57.4, here for example adjusting nuts, joint and length/axis position adjustment (also rotation). Of course also for each of the feet 52.1, 52.2 there may be provided a ball joint as an adjusting means. The bearing surfaces of each of the feet in comparison to the foot shown in FIG. 3*a* may be suitably smaller without unallowable pressure effects arising on the material surface. Furthermore this arrangement has the advantage that the tool may be supported with respect to the workpiece even with working regions which are difficult on account of the geometric nature.

The method according to the invention is explained in more detail by way of FIG. 4. A dent B in a material layer WS, e.g. the steel sheet of a vehicle body is to be repaired. On the material layer WS roughly in the middle of the dent region B the connection element 13 with its end surface 61 is pressed onto a hot-melt adhesive 19 which has been liquefied by prior heating action. After the cooling of the hot-melt adhesive 19 the connection element 13 is connected so rigidly to the material layer WS that a pulling of this layer in the dent region in the direction of the arrow Z leads to a plastic deformation of the material layer.

The connection element 13 consists essentially of an end surface 61, a transition piece 62 and a coupling head 63 which releasably cooperates with the coupling means 69 of the pulling element 15. The coupling head 63 preferably catches in a recess or flute of the coupling means 69, so that under the pulling effect the coupling head 63 is not undesirably released from the coupling means 69. In a preferred embodiment form the coupling head 63 has a centering geometry, for example a conical form, so that the application of the tool and the catching with the coupling means 69 is simplified. The arrangement of the pulling element 11 and the connection element 13 is selected such that the forces transmitted via the lever arms 151.1, 151.2 (cf. FIG. 1) act as perpendicularly as possible on the material layer WS in order to effect a uniform planishing of the dent location B.

The maximal path d2 (cf. FIG. 1) of the pulling element 15 in the direction of the arrow Z according to the invention is limited but variably adjustable. In order to achieve an adaptation to the depth of a dent B one may vary the length d4, e.g. in that a set of connection elements 13 with differing lengths of the transition piece 62 are made available. Within the framework of the method a force (F) is to be introduced essentially perpendicular to the dent region (B) by actuating the lever arms 151.1, 152.2.

The end surface 61 need not be formed level and may be adapted to the shape of a dent, e.g. in that its bearing region or practically the whole element 13 consists of one material which may be adapted by way of machining away or thermal deformation to the respective dent shape, e.g. in that the bearing region consists of a thermoplast and in the plastic condition before adhesion is pressed into the dent for adaptation to shape.

The actual planishing procedure is now effected as follows. The connection of a connection element 13 to the material layer WS is carried out as previously described. Thereafter the support means 162.1, 162.2 of the lever arms 151.1, 152.2 are adjusted and aligned with respect to a supporting element as well as further setting parameters, such as adjustable feet 52 of the bearing elements. Thereafter the pulling element 11 is connected to the connection element 13 via the coupling 63, 69 and the bearing elements 12.1, 12.2 are applied on the workpiece to be treated at the desired location. By way of actuating the lever arms 151.1, 151.2 a force F which is essentially perpendicular to the dent region B is exerted onto this dent region. After the desired plastic deformation of the dent as a rule firstly the tool is removed by releasing the coupling from the connection element 13 and finally the connection between the connection element 13 and the material layer WS is released.

The inventive concept obviously includes embodiment examples with which the grips of the lever arms 151.1, 151.2 may be actuated in a co-ordinated manner by way of an auxiliary design which likewise may be guided or supported by the rod 154.

What is claimed is:

1. A planishing device with a pulling element and lever arms connected in an articulated manner as well as bearing elements for bearing on a material layer, characterised in that the lever arms in the region of each end lying opposite each grip are connected in an articulated manner to a joint member connecting the lever arms, and the lever arms at a location distanced from each end are supported in an articulated and movable manner via stationary support means slidably positonable on a supporting element interactively connected to the bearing elements, and that the pulling element is connected to the joint member.

2. A planishing device for repairing a dent in a metal sheet, comprising:

a joint member;

a supporting arm with a bearing element at each end;

two lever arms having inner ends interconnected to each other in an articulated manner via said joint member;

a support mounted on said supporting arm, said support articulatingly engaging each of said lever arms at a distance from said inner ends with joint connections while maintaining each of said lever arms at said joint connections in a set separation from said supporting arm;

a connecting element positioned by said joint member and said supporting arm, to be temporarily attached to a surface of the metal sheet;

a pulling element connected to said connecting element, said pulling element being adjustably interconnected to said joint member; and grips formed by distal ends of said lever arms each implementing a force manually applied to said grips in a direction toward said supporting arm, to remove a dent in the metal sheet.

3. The planishing device according to claim 1, wherein the joint member is arranged between the joint connections of each support mean.

4. The planishing device according to claim 1, wherein an end surface of the connecting element consists of a material which is attachable by way of a hot-melt adhesive to the surface of the metal sheet to be repaired.

5. The planishing device according to claim 2, wherein the hot-melt adhesive comprises a polymer with polar side-group which is solid at room temperature and which softens or melts at temperatures of above 150 C.

6. The planishing device according to claim 5, wherein the polymer is one out of a group of copolymer with vinyl acetate, acrylates, acrylic acid or based on ionomers.

7. The planishing device according to claim 3, wherein the end surface of the connecting element is adoptable to the shape of a dent.

8. The planishing device according to claim 2, wherein the pulling element is interconnected to the joint member by way of a rod and an adjusting head.

9. The planishing device according to claim 2, wherein the rod is guided in a slot or in a bore so that a defined force effect is ensured.

10. The planishing device according to claim 2, wherein the supporting element is a straight rail and the support means are formed as slides mounted in a displaceable manner on the supporting arm.

11. The planishing device according to claim 10, wherein the support means, are lockable in a desired position on the supporting arm by way of adjusting means.

12. The planishing device according to claim 2, wherein the supporting arm comprises two straight rail parts.

13. The planishing device according to claim 2, wherein the pulling element is adjustably connected to the joint member in a manner such that the maximal path of the pulling element is adjustable.

14. The planishing device according to claim 2, wherein the bearing elements are arranged on the supporting arm such that the foot of the bearing elements is adjustable with respect to the supporting element with regard to the distance d1 and/or angular position.

15. The planishing device according to claim 14, wherein the bearing element have at least two feet.

16. The planishing device according to claim 2, wherein at least one foot of the bearing elements has a fastening means which is temporarily connectable and releasable to and from the material layer.

17. The planishing device according to claim 2, wherein the linkage location of the joint member and of the support means of the lever arms and the grips of the lever arms are distanced from one another in a manner such that the lever arms have a transmission ratio of at least 1:3.

18. A method for removing a dent in a metal sheet material by a planishing device, comprising the steps of:

a) attaching an end surface of a connecting element to a surface of a metal sheet in the region of a dent by a hot melt adhesive;

b) applying bearing elements of the planishing device to the metal sheet;

c) adjusting height and position of the bearing elements and a pulling element with respect to the connecting element;

d) interconnecting the connecting element of the planishing device via the pulling element with inner ends of a pair of lever arms of the planishing device which are each at a distance d1 from their inner end supported in an articulated manner by a joint connection on a support mean mounted on the supporting arm;

e) exerting a force essentially perpendicular onto the dent region by pressing the outer ends of the lever arms in the direction of the supporting arm such that the dent is plastically deformed; and f) releasing the connection between the connection element and the material layer.

19. A method according to claim 18, wherein the hot melt adhesive comprises a polymer with polar side-group which is solid at room temperature and which softens or melts at temperatures of above 150 C.

20. A method according to claim 19, wherein the polymer is one out of a group of copolymer with vinyl acetate, acrylates, acrylic acid or based on ionomers.

21. A method according to claim 18, wherein the end surface of the connecting element is adoptable to the shape of the dent.

22. A method according to claim 18, wherein the adjusting of the position of the bearing elements and the pulling element with respect to the connecting element is done by sliding the support means along the supporting arm which is built out as straight rail.

23. A planishing device for repairing a dent in a metal sheet, comprising:

a joint member;

a plurality of bearing elements;

a supporting arm exhibiting a length terminated at each end by one of said bearing elements;

two lever arms having inner ends interconnected to each other in an articulated manner via said joint member;

a connecting element positioned by said joint member and said supporting arm, to be temporarily attached to a surface of the metal sheet;

a pulling element connected to said connecting element, said pulling element being adjustably interconnected to said joint member;

a support articulatingly engaging each of said lever arms at a distance from said inner ends, said support being slidably mounted on said supporting arm to adjustably position said pulling element along said length; and grips formed by distal ends of said lever arms each implementing a force manually applied to said grips in a direction toward said supporting arm, to remove a dent in the metal sheet.

24. A planishing device for repairing a dent in a metal sheet, comprising:

a joint member;

a supporting arm with a bearing element at each end;

two lever arms having inner ends interconnected to each other in an articulated manner via said joint member;

a support mounted on said supporting arm, said support articulatingly engaging each of said lever arms at joint connections formed by fulcrums positioned at a distance from said inner ends;

a connecting element positioned by said joint member and said supporting arm, to be temporarily attached to a surface of the metal sheet;

a pulling element connected to said connecting element, said pulling element being adjustably interconnected to said joint member; and grips formed by distal ends of said lever arms each implementing a force manually applied to said grips in a direction toward said supporting arm, to remove a dent in the metal sheet.

25. A planishing device for repairing a dent in a metal sheet, comprising:

a joint member;

a supporting arm with a bearing element at each end;

two lever arms having inner ends interconnected to each other in an articulated manner via said joint member;

a support providing spaced-apart projections rigidly extending from said supporting arm, said support articulatingly engaging each of said lever arms at a distance from said inner ends with joint connections while enabling said lever arms to place said joint member in proximity to said supporting arm;

a connecting element positioned by said joint member and said supporting arm, to be temporarily attached to a surface of the metal sheet;

a pulling element connected to said connecting element, said pulling element being adjustably interconnected to said joint member; and grips formed by distal ends of said lever arms each implementing a force manually applied to said grips in a direction toward said supporting arm, to remove a dent in the metal sheet.

* * * * *